United States Patent [19]

Blakey et al.

[11] 4,048,380

[45] Sept. 13, 1977

[54] CAST COATED PAPER AND ITS PRODUCTION AND COMPOSITIONS FOR IT

[75] Inventors: René C. Blakey, Wrea Green; Robert G. Riddell, Hoghton; John Whittaker, Darwen; John A. Wilson, Chadderton, all of England

[73] Assignee: Star Paper Limited, England

[21] Appl. No.: 652,118

[22] Filed: Jan. 26, 1976

[30] Foreign Application Priority Data

Jan. 31, 1975 United Kingdom ..... 4234/75

[51] Int. Cl.[2] ..... B05D 3/12

[52] U.S. Cl. ..... 428/511; 260/29.6 RW; 260/29.6 RB; 260/29.7 UA; 260/29.7 W; 260/42.47; 260/42.55; 427/362; 427/336

[58] Field of Search ..... 427/362, 336; 260/29.6 RW, 29.6 RB, 29.7 W, 29.7 UA, 42.47, 42.55; 428/511

[56] References Cited

U.S. PATENT DOCUMENTS

| | | | |
|---|---|---|---|
| 3,575,707 | 4/1971 | Ploetz et al. | 427/362 |
| 3,583,881 | 6/1971 | Kennedy | 427/362 |
| 3,600,215 | 8/1971 | Mervine | 427/362 |
| 3,681,116 | 8/1972 | Reich et al. | 427/362 |
| 3,687,711 | 8/1972 | Blanco | 427/362 |

*Primary Examiner*—Michael R. Lusignan
*Attorney, Agent, or Firm*—Anthony J. DeLaurentis

[57] ABSTRACT

Cast coating compositions, processes of using them and cast coated products are described. The compositions comprise pigment and binder, and the binder includes a polymer which has Tg from 0° to 45° C, Tg-Tf from 5° to 25° C and which is in the form of a latex having an average particle size of less than 0.5 microns.

28 Claims, 3 Drawing Figures

Figures 1A, 1B, 2:
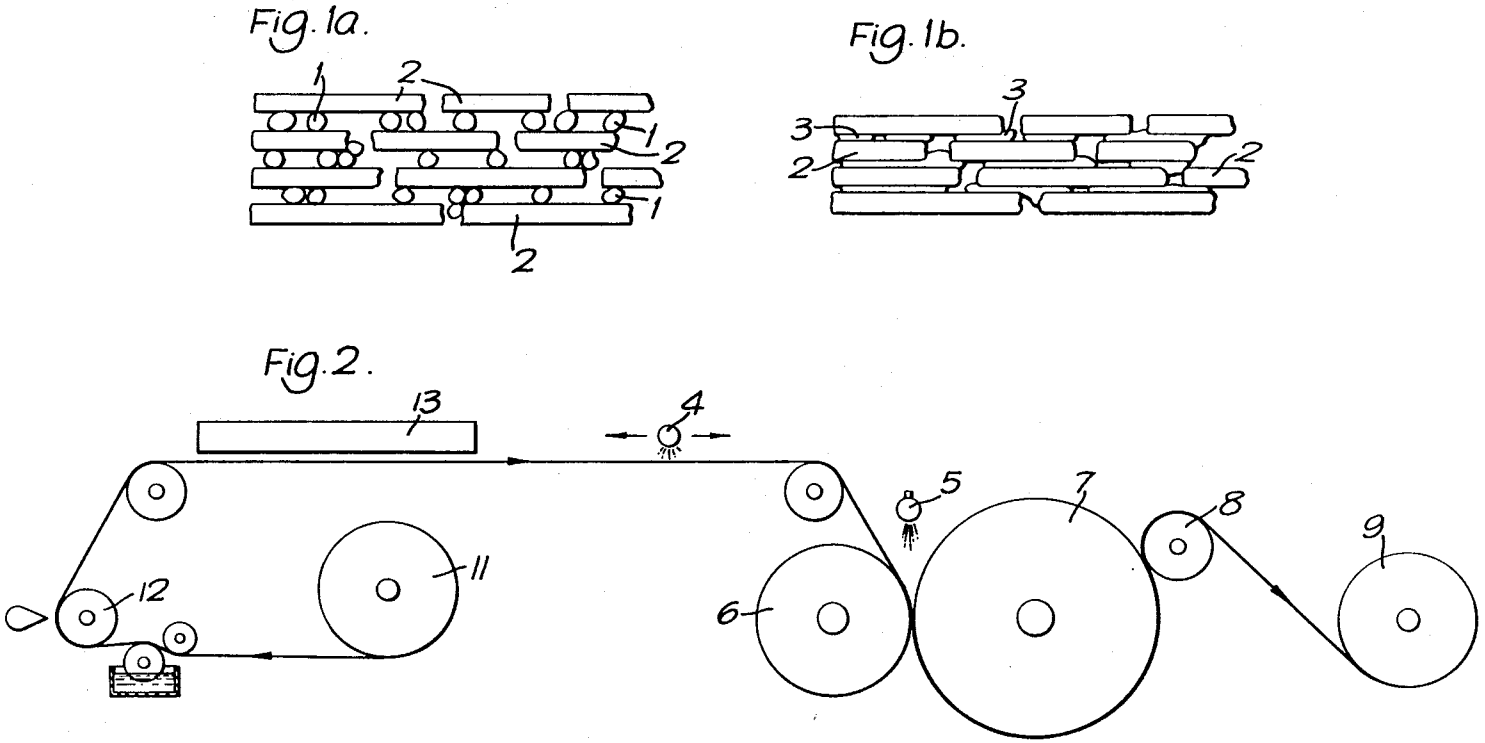

1
2
3
4
5
6
7
8
9
11
12
13

CAST COATED PAPER AND ITS PRODUCTION AND COMPOSITIONS FOR IT

This invention relates to cast coated products in which the coating is a mineral composition, and to their manufacture. The term "cast coated" is well understood in the paper trade and is characterised as a coating having exceptional specular reflectance and smoothness, in other words a mirror-like finish.

As is well known, mineral coating compositions for cast coating comprise a major proportion, at least 60% dry weight, pigment and a minor proportion, less than 40% dry weight, of an organic binder. There have been two general methods of casting with such compositions. The first is described in U.S. Pat. No. 1,719,166, and in this web of paper is coated with a mineral coating composition and while this coating is still wet and mouldable it is placed in contact with a heated chromium plated cylinder and removed when dry. Because of the nature of the composition and the large amount of water, the casting cylinder has to be operated below 100° C, e.g. 80° to 90° C, and the process necessarily is slow, the substrate usually being coated at below 30 meters per minute, even when a large, e.g. 3.7 meters diameter, and therefore expensive casting cylinder is used.

In the second method, described in U.S. Pat. No. 2,919,205, productivity of the process was substantially improved by gelling the aqueous coating composition after it had been coated on the web but before it was brought into contact with the casting cylinder. Gelling gave many advantages. Thus the dry coating thickness was similar to the original wet thickness, water drained more rapidly from the coating because the pigment was immobilised in a bulky coating, and the coating was more cohesive and less adhesive and so was less prone to stick to the casting cylinder. Various ways of gelling have been proposed, but the one we have found most satisfactory has involved heating the coating in order to activate a reaction, as in U.S. Pat. No. 3,356,517. Thus a typical method comprises applying the aqueous coating, heating it sufficient to cause gelling and then pressing against a casting cylinder at a high temperature, e.g. 120° C, the pressure usually being exerted by a resilient roll. The heating necessary to bring about gelling is relatively small, and although it may result in some drying the product is still wet when it is cast. Despite this the product can be satisfactorily operated at, for example three time the speed of the first method with a smaller casting cylinder.

However the gelled coating method does have certain disadvantages. First, the binder is generally based on casein or other high quality proteinaceous adhesive and these can be of variable quality and of restricted availability. Second, it is not possible to dry the coated substrate to any significant extent before casting. This is because drying of the gelled coating results in insolubilisation so that even if one wets the coating before casting inferior results are obtained. Because one cannot dry the coating significantly before casting and because it is commercially desirable to use high casting temperatures, a high steam pressure develops in the web during its passage through the casting nip and if the fibrous web is low in porosity or weak in internal bonding strength then the web will be blown apart as it leaves the nip. Similarly any localised dense areas in the web, which are not uncommon even in high grade paper and board, will result in localised pressure build-up, and this can result in blisters being formed. Another difficulty arises from the tendency of non-uniform gelling as a result of which some mineral aggregates are not gelled uniformly or are gelled too must or too early and so are not well bound into the coating layer and tend to be blown or plucked out during casting, leaving "pits" in the surface.

Finally, the need to formulate a composition that is capable of gelling imposes restrictions upon materials that can be included in the composition. For example most gellable systems now being used have to be acidic, which means that one cannot use alkaline pigments, such as calcium carbonate and satin white, and also it can be difficult to obtain stable dispersions of clays under acid conditions because localised flocculation can occur and this will cause pits in the cast coating.

It has been our object to avoid the disadvantages of the gelled type of system while maintaining the provision of a bulky porous coating and the advantage that come from that. In particular it has been our object to device such a system in which the binder for the pigment is based on synthetic polymers instead of being based on casein or other naturally occuring polymer. A further object has been to make pigment cast coatings that are formulated of materials such that they can be applied and cast easily and quickly to a very high finish without any substantial restriction on the pH of the system or of the components that are included in it.

It has already been proposed to use synthetic polymeric binders in pigment cast coatings, but such processes generally have not provided such a porous bulky structure as in the gelled system described above. For instance in U.S. Pat. No. 3,832,216 a process is described in which a mixture of latices comprising more than 50% of an alkali insoluble or non-swellable latex and less than 50% of an alkali swellable or soluble latex is used at an acidic pH. A wide variety of polymers are proposed as the alkali swellable and alkali non-swellable latices. In the Examples the major binder is a soft latex with the result the structure obtained still is not as bulky as is desirable and the process suffers from the limitation that it must be operated at an acidic pH, with the result that the choice of coating ingredients is limited.

We have now found that the aforementioned objects are achieved if we use as binder a particular class of polymer latices. So far as we are aware no latices of this class have ever been proposed for use as binders in pigment cast coatings and their use permits the attainment in a very easy manner of the desired bulky porous coating at any convenient pH and can be applied and cast easily and quickly to give a very high cast finish.

An aqueous cast coating composition according to the invention comprises, per 100 parts by weight solids, at least 60 parts pigment and less than 40 parts binder and in this from 40 to 100% dry weight of the binder is a polymer which has Tg from 0° to 45° C and Tg — Tf from 5° to 25° C and which is in the form of a latex having an average particle size of less than 0.5 microns.

A cast coating may be made on a substrate by applying such a composition to the substrate, drying the coated substrate so that at least half the water applied with the composition is removed, applying water to the surface of the coating and molding the coating.

Tg is the glass transition temperature of the dry polymer as measured by one of the established techniques such as differential thermal analysis, dilatometry, or measurement of variation in a strength property with temperature. Tg is a fundamental property of polymeric materials.

Tf is the film formation temperature of the polymer latex that is incorporated in the cast coating composition. This is determined by measuring the temperature at which a layer of the latex on a non permeable substrate changes from a powdery deposit to a continuous film under standardised conditions. For hydrophobic polymers Tg and Tf are very similar although molecular weight and particle size can influence Tf. For hydrophilic polymers however since water softens the polymer the Tf value will be below the Tg value. Tf is affected by, inter alia, the chemical constitution of the polymer, its molecular weight and its particle size. Tf can also be influenced by factors affecting the rate of water removal, such as the amount and type of any protective colloid or surfactant or polar groups in the latex. Preferably Tf is substantially unaffected by changes in pH but if it is affected then Tf should be measured substantially at the pH at which the coating composition will be applied.

Tg values below 0° C can be recorded but it is impracticable to record Tf belows below 0° C and for the purposes of the present invention we consider that the polymer has the specified Tg — Tf differential if Tf is 0° C or lower provided that Tg is above 5° C.

The polymers used in the invention are a narrow selection out of a class that can conveniently be termed "hydroplastic polymers", in that they are polymers that can be plasticised by water. However it must be emphasised that only the narrow range of polymers falling within the definition given are within the scope of the invention and even though a polymer may be plasticisable by water it will not be satisfactory unless it complies with the Tg, Tg — Tf and particle size definitions given above.

The polymers usable in the invention can loosely be described as hard polymers that are well plasticised by water. It seems that in the preferred way of using the polymers the hardness of the binder particles results in the formation of a bulky structure after the initial drying but the film-forming temperature and the particle size results in the polymer particles binding the pigment particles despite the hardness of the polymer particles. Upon re-wetting of the surface the binder particles at the surface are softened by contact with water so that upon moulding the pigment particles substantially instantaneously, e.g. within about 1/50 of a second, become aligned to and into intimate contact with the moulding surface. The coating adheres to the moulding surface until the surface of the coating dries and the binder hardens sufficiently to release cleanly from the surface. The released product then replicates the mirror finish of the molding surface and has the typical finish of a cast coated product.

If Tg is too high, above 45° C, the ability of the particles to bond the coating adequately and to permit the coating to mold will be reduced, but if the hardness is too low, Tg below 0 ° C, the particles are sufficiently soft that the desired bulky structure is not attained so that the rate of evaporation of water through the coated substrate is rather low and speed of operation has to be reduced to permit adequate drying, and also to permit adequate wetting. If drying is not adequate water may be trapped between the coated surface and the casting cylinder and form pockets of steam which may reduce the gloss in the area of the pockets. If the porosity of the coating is so low that inadequate wetting of the surface layers occurs then final molding will be impaired because the surface layers will not have been plasticised adequately to permit optimum alignment of the pigment particles to the moulding surface.

As an indication of how the absorbency of the coating is affected by Tg we have cast coated pigment compositions containing as binder the conventional gellable casein type of binder and also containing various synthetic polymers having different Tg values. The absorbency values for the gellable casein type product are generally from 0.1 to 0.2 units while that for a synthetic polymer having Tg 32° C (e.g. a particular homopolymer of polyvinyl acetate) is 0.15 units, that for a synthetic polymer having Tg 5° C (e.g. a particular copolymer of 80 units polyvinyl acetate : 20 units butyl acrylate) is 0.27 units, and that for a polymer having Tg — 20° C (e.g. a copolymer of 60 units polyvinyl acetate : 40 units butyl acrylate) is 0.6 units. The test used comprises applying a controlled thickness of ink to the cast surface and allowing the ink to penetrate for a fixed time prior to bringing the inked surface in contact with a smooth coated paper under fixed pressure and measuring the amount of wet ink transferred to this latter paper by the density of the ink film transferred. All conditions of the test are standardised and the method is widely used to assess absorbency of coated papers and the higher the density value obtained the lower the absorbency.

From this it can be seen that a Tg value of −20° C is too low, while values of +5° and +32° C are satisfactory. Preferred values of Tg are below 35° C, most preferably 5° to 35° C.

Tf is often preferably from 5° to 20° C but in any event Tg — Tf is preferably from 10° to 20° C. Values of Tg — Tf of between 12° and 20° C allow the invention to be operated according to the best conditions for speed, i.e. the amount of water picked up at the rewetting stage is of the preferred magnitude. If however the differential is higher than 20° C then the rewetting step will soften the coating excessively and the pick up and penetration of the water is increased which necessitates slowing down the process in order to increase the time for removing excess water from the high hydrophilic polymer. If Tg — Tf is lower, for instance if Tg is 12° C, Tf is 5° C and Tg — Tf is 7° C, the plasticising effect of the rewetting step is reduced and in order to obtain the desired moldability it is desirable to have a higher moisture content prior to rewetting. The use of a softer copolymer only has a small compensating effect on mouldability and although such latices are practical they are less likely to give maximum speed due to the greater drying demand placed on the casting cylinder and also the necessity to reduce cylinder temperature due to decreased porosity of the coating.

Most at least of commercially available polymer latices do not comply with the narrow definition give above and so cannot be used as the essential component of the binder in the invention. However a few suitable binder latices are commercially available and in any event it is easy, once having specified the required particle size, Tg and Tf, to synthesise a latex having these properties merely by appropriate choice of the known variables in latex formation, for instance particle size, molecular weight and reaction components, all in conventional manner.

The preferred polymers for use in the invention are emulsion polymers of vinyl esters of a carboxylic acid, notably vinyl acetate, propionate and caproate and copolymers and terpolymers of these with 2-ethyhexyl acrylate, butyl acrylate, versatic acid, vinyl chloride, and the like. The amount of comonomer with the vinyl ester is generally less than 40% of polymer weight to achieve the specified characteristics. Other suitable polymers include copolymers of acrylic and methacrylic esters and also copolymers of these esters with styrene or butadiene. It must be appreciated that although we say that, for instance, polyvinyl acetate homopolymer is preferred for use in the invention, only those polyvinyl acetate polymers having the defined Tg, Tg — Tf and particle size values are usable.

The polymer will not contain so many carboxylic acid or other groups that it is soluble or highly swellable in alkali, since such polymers will have no measurable Tf, will not comply with the definitions given above, and will be too hydrophilic and will destroy the porosity of the coating. Many polyvinyl acetate and other polymers do contain small amount of carboxylic groups to confer emulsion stability and improve binder efficiency, and if the amount is high, for example above 4 or more, usually above 7%, this renders the polymers alkali soluble or highly swellable. The polymers used in the invention usually contains less than 1% of these groups and in any event the amount is preferably insufficient to class the polymers as alkali swellable.

Since the polymers are not pH sensitive over wide limits the composition can be formulated and cast under acidic or alkaline conditions without any effect on performance. For instance the composition can have a pH of from 5 to 10. It is generally preferred to operate at a pH above 7, preferably 7 to 9, since this allows greatest compatibility with all commonly used pigments and other coating constituents.

Although the defined polymer, or a mixture of such polymers, can be used as the sole binder component, it is often advantageous to include other polymers to serve as supplementary binders. These other polymers may be present in an amount of up to 60%, so that the defined polymer constitutes from 40 to 100% of the total binder. Preferably it constitutes at least 50%, and usually at least 60 or 70% of the total binder. The preferred supplementary binder is a soft hydroplastic polymer with a Tg value normally below 0° C. We believe the beneficial effect of such mixtures is firstly that the softer material acts as an efficient binder but are not present in sufficient quantity to destroy the porous structure previously illustrated. Secondly they remain an efficient binder at the rewetting stage and maintain sufficient strength in the coating at this step, that is, they prevent the disruption of the coating that can occur on rewetting the highly hydroplastic binders.

Thirdly since these supplementary binders are somewhat hydrophilic they do not significantly hinder the rewetting of the major hydroplastic component but at the same time exhibit some of the desirable properties of being softened by water to aid molding and increase in hardness as the water is removed. Butadiene methylmethacrylate and some stryene acrylic copolymers have been found to be suitable co-binders. If however only a small proportion of supplementary binder, for example less than 20% of the total binder, is required to maintain coating strength then almost any latex may be employed such as the widely used styrene butadiene types.

It is further possible to adjust the properties of the coating by inclusion of hard latices with Tg values above 45° C, for example polystyrene latices. These harder polymers assist only in maintaining the porous structure and do not contribute to binding of the pigments.

Any such supplementary binders normally also will not be alkali sensitive. Thus they will normally contain less than 4% of carboxyl or other acidic groups that might render them alkali sensitive.

Particularly preferred binder compositions are mixtures of polyvinyl acetate homopolymer having the defined Tg, Tg — Tf and particle size values with, as softer polymer, a butadiene methyl methacrylate copolymer or a styrene acrylic copolymer.

Of course in the invention the amount of pigment is such that the binder particles do not form into a film. Some particles of the latex may agglomerate together to some extent but still remain in discrete form. Due to the hardness of the polymer the particles do not readily deform during drying unlike most of the more commonly empolyed synthetic polymer latices used as binders in mineral coatings for paper.

This concept is shown schematically in FIGS. 1*a* and 1*b* of the accompanying drawings. Each of these is a section through part of a coating made in the invention. Each section shows four layers of pigment in two dimensions only, but it should be appreciated that the actual coating will generally contain of the order of one hundred layers of pigment.

FIG. 1*a* shows a useful polyvinyl acetate homopolymer with particles 1 of 0.15 microns diameter which is similar in size to the thickness of particles 2 of high quality clay (Kaolin) used as the predominant pigment in mineral coatings. The binding action of the latex is essentially to spot-weld the pigment particles together. In FIG. 1*b* the effect of a synthetic polymer latex that has a more usual value of Tg, i.e. is must softer, is illustrated. The softness of the particles causes them to flow and form a film 3 between the pigment particles. Clearly the mobility of the latter makes them more efficient as adhesives but at the same time it is obivous that this efficiency creates a dense coating layer which lacks the permeability of harder polymers such as polyvinyl acetate illustrated in FIG. 1*a* . Thus by using a hard polymer we obtain a more bulky and porous structure and thus achieve the advantages obtainable with a gelled coating as discussed above, without incurring the disadvantages such as the inability to dry before moulding, and restrictions on components in the composition.

The binding by point contact as shown in FIG. 1*a* also places constraint on the particle size of the polymer latices useful for the invention. The effect of doubling the particle size increases the volume of a particle by eight times and so for a given weight addition of binder the number of particles is reduced to an eighth. Thus we find that the use of a hard polymer with a Tg of about +30° C when used in the proportion of 15 parts by weight of polymer to 100 parts by weight of pigment will give adequate coating strength when the particles are below an average diameter of 0.25 microns but the strength may be less satisfactory when the average particle diameter is about 0.35 microns. The lack of binding power of larger particles can be compensated for by increasing the amount of binder, although this is an uneconomic approach, and also by addition of supplementary binders as described later but if too much supplementary binder is used then the hydroplasticity of the coating is diminished. The preferred particle size for the prodominant hydroplastic binder is therefore below 0.3 microns average diameter when the Tg of the polymer is at the upper limit of +45° C and below 0.5 microns average diameter when the Tg approaches the lower preferred limit of 0° C, with preferred maximum particle sizes for intermediate values of Tg being readily ascertainable, e.g. by interpolation.

Preferably the dry weight of the defined polymer is, per 100 parts dry weight of pigment, at least 5 parts but generally below 20 parts. Preferred amounts are 8 to 16 parts dry weight of the specified polymer per 100 parts dry weight of the pigment.

The proportion of pigment to binder is generally within conventional ranges for example from 60 to 95 parts pigment per 100 parts dry weight composition, with the balance being binder, and most preferably 80 to 95 parts pigment. The composition that is applied is an aqueous composition and generally contains from 50 to 120 parts water per 100 parts be weight binder and pigment. Minor additions of defoamers, viscosity modifiers, tinting dyes and other ancillary chemicals may be added to the coating composition as desired. The coating composition can include any of the commercially available pigments empolyed in mineral coating compositions provided that the usual precautions, known to those skilled in the art, with respect to dispersion and compatibility are taken. The pigments include clays, calcium carbonates, hydrated alumina, satin white, polymeric pigments and coloured pigments.

The substrate coated with the composition is generally fibrous, i.e. paper or paper board. The fibres of the substrate may be of synthetic polymeric material but preferably comprise cellulose fibres.

An apparatus for practising the invention is shown in FIG. 2. A continuous web of paper or board 11 is unwound and is coated any suitable coater 12. An air knife is illustrated but since the rheology and solids content of the coating composition is easily modified it may be applied by other methods such as trailing blade, smoothing roll or metering bar. The only criteria for selection of coater is that it should be capable of smoothly applying an appropriate dry coat weight, e.g. of between 15 and 30 grammes per square meter. The coat weight empolyed in the invention is governed by the quality of the base stock used and must be adequate to fully cover the fibres. In practice we find that between 20 and 25 grams per square meter of dry coating is satisfactory for the majority of base stocks. From the coating apparatus the web passes into a drying section 13. Because of the high porosity of the coating the drying rate is not critical and this in turn allows most drying methods to be employed. If infra-red heating is used it should not be at too high a temperature and should be continued for sufficiently long to achieve the desired degree of evaporation, but preferably a hot oven or similar heater is used.

The heating must be continued for sufficiently long that at least half and preferably at least three quarters of the added moisture is driven off. The moisture content applied to the web is generally of the order of 3 to 8% of the weight of the coated substrate. What is being aimed at in the drying step is that after drying and before moulding the coated substrate shall have a moisture content that is close to the equilibrium moisture content of the substrate, that is to say the moisture content which would be in quilibrium with an atmosphere of 45 to 55% relative humidity. Preferably the coated substrate after drying would have a moisture content of not more than 2%, and preferably not more than 1%, above the equilibrium moisture content, and most preferably it will possess the equilibrium moisture content. The amount of moisture left in the coated substrate is influenced by the hydroplasticity of the coating as described earlier.

Having dried the substrate to this extent, there is then inadequate moisture in it to permit moulding, and so the surface of the coating has to be moistened to permit moulding.

The amount of water added is always small, for example 0.2 to 2%, and preferably 0.5 to 1.5%, generally about 1%, water based on the weight of the product. It may be added to the surface of the coating in any convenient manner, for example by sprays 4 or by forming a pond of water in the valley created by the coated web and the casting cylinder 7 and regulating the supply of this water through a perforated feed pipe 5. The position of the sprays and the depth of the pond may be adjusted according to speed. It is of course conventional to have a pond of boiling water in the nip prior to moulding, but the conditions generally are such as to produce a very wet coating. In the invention if a pond is used it must be adjusted so that only very small pick-up of water occurs, and preferably sprays or other means of applying the coating are used.

The treated web is then moulded, e.g. in a casting nip that can be designed and operated in conventional manner. Thus the web may be passed through a pressure nip formed by a resilient roll and a highly polished normally chromium plated casting cylinder 7. The pressure is high, e.g. above 10, and usually within the range of 35 to 70, kilogrammes per square centimeter and is sufficient to effect molding of the surface without permanently diminishing the thickness and rigidity of the base. At the same time the pressure is also sufficient to maintain the coating in contact with the casting cylinder while the surface moisture is driven through the porous coating structure into the base. The diameter of the casting cylinder and its temperature is related to speed and a cylinder of 1.22 meters diameter operating at 120° to 130° C is adequate for speeds of 60 to 75 meters per minute. Cylinder temperatures of 100° to 150° C can conveniently be used. When the coating has been redried by intimate contact with the casting cylinder it will release easily and is taken off via roll 8 and reeled up at 9. Various known methods of controlling moisture content or curl may be added between points 8 and 9 and additionally the web may be fed directly from 8 into an apparatus for cutting the web into sheets.

It is of course necessary that during moulding the binder should contact the casting cylinder intimately so that it can acquire the finish of the cylinder but that it shall not stick too much. In the present invention, however, the choice of the specified, hydroplastic, polymer, lessens the tendency to sticking. Furthermore this polymer is tacky when plasticised by water in the manner described above and so adheres well to the cylinder in the early stages but as the water is removed so the tack decreases. One of the criteria used in selecting supplementary binders for use in the invention is that they should possess low tack at the temperatures employed. We therefore have a composition which has inherently good release properties but at the same time has excellent adhesion to the chromium plated casting cylinder during the moulding stage when the surface layer is in a wet state. In practice, however, we find some circumstances where minor problems due to poor release can occur, for example, uneven coating application or using casting temperatures near 150° C in order to achieve speed. To cope with such circumstances we find that the inclusion of a small amount of a release agent in the water used for rewetting gives adequate control over release problems.

A wide variety of release agents may be used for this purpose. They must of course be stable in boiling water. Typical are emulsions of polyethylene, waxes, metallic stearates and ketene dimer as well as surfactants based on fatty acids and sulphonated oils. The amount generally has to be at least 0.02 dry parts per 100 parts rewetting water. If the amount is too great then there may be difficulty in printing onto the final surface but generally we find it satisfactory to use amounts of up to 0.15 parts. For instance typically 0.04 parts of a low molecular weight oxidised polyethylene emulsion may be used.

In addition to having the advantages that the process is a high speed process, e.g. greater than 30 and usually greater than 50 meters per minute, for making an extremely good cast product, it also has the advantage that the speed of the process is compatible with many board machines and so the apparatus used for the invention can be placed in-line with the board or paper manufacturing machine in order to reduce handling costs. Similarly substantial economies in operation can be made by coating and drying of the substrate on a paper or board making machine which will allow the coating unit (2) and drying section (3) shown in FIG. 2 to be omitted. Similar economies can also be achieved by coating the base on a high speed off-machine coater which then supplies several casting units.

The following are some typical Examples of the invention.

EXAMPLE 1

100 dry parts by weight of English coating clay were mixed under high shear with 43 parts of water, 0.2 parts of tetrasodium pyrophosphate, 0.1 part sodium polyacrylate and 0.2 parts of sodium carbonate to provide a uniform dispersion of the pigment.

The clay slurry was diluted to 60% solids by weight prior to addition of 0.3 parts of tributoxyethyl phosphate (as an emulsion in water) to act as defoamer and followed by 10 dry parts of vinyl acetate homopolymer latex having Tg = 32° C and Tf = 18° C having an average particle size of 0.17 microns, and 5 dry parts of a butadiene methyl methacrylate copolymer containing 40% of butadiene - 1,3 units and 60% of methyl methacrylate units and having a Tg of −11° C. The vinyl acetate polymer was a specially prepared polyvinyl acetate homopolymer free from acid groups to demonstrate that the ability of the latex to mould is not dependent on it being responsive to alkali.

The composition was further diluted to obtain a viscosity of 360 centipoises measured at a shear rate of 30 $sec^{-1}$ and at a temperature of 20° C at which point the coating had a solids content of 48.1% by weight and a pH of 8.4.

The coating was used on an apparatus previously described and illustrated in FIG. 2 and a dry coat weight of 22 grams per square meter was applied by the air knife to a 195 grams per square meter paperboard base. The coated web was dried by means of gas fired infra red heaters to a moisture content of 6% by weight of the total product. The web was then passed through a nip formed by a rubber covered roll of 0.75 meters diameter and a chromium plated cylinder of 1.22 meters diameter. The valley of the nip contained a pond of boiling water to a maximum depth of 1.5 centimeters which was known to give a pick up of approximately 1% water at the operating speed of 60 meters a minute. The water used contained 0.08 dry parts of an emulsion of oxidised polyethylene for each 100 parts of water. The coated surface was pressed against the casting cylinder at a pressure of 46 kilogrammes per square centimeter and the cylinder temperature was maintained at 125° C. The web released cleanly from the cylinder after 180° contact and yielded a smooth product having a gloss of 90% measured at an angle of 75° to the vertical plane. The product was similar in all characteristics to cast coated paperboard produced by prior art of gelled coatings.

EXAMPLE 2

As an illustration of the versatility of the process the coating from Example 1 was diluted to 43.0% solids which gave a viscosity of 150 centipoises measured at a shear rate of 30 $sec^{-1}$ and a temperature of 20° C. It was then coated onto the same type of base by using a separate air-knife coater operating at a speed of 280 meters a minute and the coated web dried to a moisture content of 7% by weight using a hot air drying system. The coated web was then transferred to the casting machine and the coating and drying sections by-passed.

All other conditions were kept the same as Example 1 except that the level of boiling water in the nip space was increased to approximately 2 centimeters and the machine operated at a speed of 70 meters a minute. The product was virtually identical to that obtained in Example 1 and had a gloss of 88% measured at an angle of 75°.

EXAMPLE 3

The conditions of Example 1 were repeated with the only change being the replacement of 10 dry parts of the English clay by an equivalent weight of a polystyrene latex having an average particle size of 0.5 microns in diameter. This material is non film forming and acts as a pigment and was substituted to increase the bulk of the coating.

The resultant product had a slightly increased gloss of 92% at an angle of 75° and other characteristics were similar to the product produced in Example 1.

EXAMPLE 4

80 dry parts by weight of English coating clay prepared in the manner described in Example 1, were mixed with 20 dry parts of a commercially available dispersed and stabilised satin white pigment.

To this pigment mixture were added 0.5 parts of octyl alcohol as defoamer followed by 8 dry parts of vinyl acetate homopolymer latex having Tg = 32° C and Tf = 18° C and particle size 0.2 microns and 8 dry parts of butadiene methylmethacrylate copolymer latex having Tg = −11° C. The mixture was diluted to a viscosity of 300 centipoises measured at a shear rate of 30 $sec^{-1}$ and a temperature of 20° C. The dry solids content was 43% by weight and the pH 9.1.

Using the same equipment as Example 1 a coat weight of 24 grames per square meter was applied to a paper base of 90 grams per square meter and then dried to a total moisture content of 5%. A boiling pond of 2 centimeters was used and the polyethylene release agent was used at a rate of 0.03 dry parts polymer to 100 parts of water. The speed was 70 meters a minute and the casting cylinder temperature maintained at 130° C. The product released well and had a gloss of 92% measured at an angle of 75°.

EXAMPLE 5

The satin white in Example 4 was replaced by a water ground natural calcium carbonate having 90% of its particles less than 2 microns. The defoamer type and amount was as in Example 4 but 12 dry parts of the polyvinyl acetate latex of Example 4 was used with 4 dry parts of butadiene methylmethacrylate. The composition was diluted to a viscosity of 350 centipoises measured at a shear rate of 30 $sec^{-1}$ and a temperature of 20° C. The solids content was 49% by weight and the pH 8.5.

Manufacturing conditions were similar to Example 4 and the resultant product has a gloss of 18% measured at an angle of 75°.

EXAMPLE 6

The process of Example 1 was repeated except that the pva used was pva sold under the trade name of National 125-1104 and manufactured by National Adhesives and Resins Limited. It is a copolymer of polyvinyl acetate and a polar monomer in which the level of the latter is insufficient to produce any discernable alkali response. It has Tg = +31° C, Tf = +14° C and particle size 0.15 microns.

The butadiene methyl methacrylate latex is sold under the trade name Butakon ML577/1 and is supplied by Revertex Limited. Substantially the same results are obtained as in Example 1.

The process of Example 1 was repeated except that PVA was replaced by a latex of a copolymer of 80 units of vinyl acetate and 20 units of butyl acrylate having a Tg of +5° C and a Tf below 0° C and a particle size of 0.17 microns. The coating and moulding conditions were the same as in Example 1 except that the coated substrate was dried to a moisture content of 9%, the estimated water pick-up was 0.5% and the speed was reduced to 50 meters per minute. The resultant gloss was 89%.

Similar results to those obtained in, for instance, Example 1 are obtainable by repeating the process of Example 1 but using, instead of the defined PVA, a polymer having the same or similar Tg, Tf and particle size values and which is, for instance, a copolymer of vinyl acetate with vinyl chloride, vinyl acetate with 2-ethylhexylacrylate and butylacrylate, vinyl acetate with versatic acid and vinyl chloride, a vinyl propionate hompolymer, a methylacrylate polymer or copolymer of methylmethacrylate with styrene or butadiene.

We claim:

1. A process of forming a cast coating on a substrate comprising: applying to the substrate an aqueous coating composition comprising, per 100 parts by weight solids, at least 60 parts pigment and less than 40 parts of a synthetic resin binder, in which from 40 to 100% dry weight of the binder is a polymer which has a Tg from 0° to 45° C and a Tg—Tf from 5° to 25° C. and which is in the form of a latex having an average particle size of less than 0.5 microns; drying the coated substrate so that at least half the water applied with the coating composition is removed; applying water to the surface of the coating and molding the coating.

2. A process according to claim 1 in which the drying of the coated substrate is so conducted that the substrate after the drying has a moisture content of not more than 2% above the equilibrium moisture content and the amount of water applied to the surface of the dried coating is 0.2 to 2%, based on the weight of coated product, and the moulding is conducted against a polished cylinder at a temperature of 100° to 150° C.

3. A process according to claim 1 in which drying of the coated substrate is so conducted that the substrate after the drying has a moisture content of not more than 1% above the equilibrium moisture content, the amount of water applied is from 0.5 to 1.5% based on the weight of coated product, the water is applied by sprays and the molding is conducted at a pressure of 35 to 70 $kg/cm^2$.

4. A process according to claim 1 in which the applied water includes at least 0.02% dry weight of a release agent.

5. A process according to claim 4 in which the release agent is an oxidised polyethylene emulsion.

6. A process according to claim 1 in which the substrate is paper or a paper board.

7. A process according to claim 1 in which the Tg of the polymer in said composition is from 0° to 35° C.

8. A process according to claim 1 in which the Tg is from 5° to 35° C. and Tg—Tf is from 10° to 20° C.

9. A cast coated product made by a process according to claim 1.

10. A process according to claim 2 in which the applied water includes at least 0.02% dry weight of a release agent.

11. A process according to claim 10 in which the release agent is an oxidized polyethylene emulsion.

12. A process according to claim 12 in which the substrate is paper or a paper board.

13. A process according to claim 2 in which the Tg of the polymer in said composition is from 0° to 35° C.

14. The process according to claim 2 in which the Tg is from 5° to 35° C. and Tg—Tf is from 10° to 20° C.

15. A process according to claim 1 in which the average particle size of the latex is less than 0.3 microns.

16. A process according to claim 2 in which the average particle size of the latex is less than 0.3 microns.

17. A process according to claim 1 in which the coating composition has a pH above 7.

18. A process according to claim 2 in which the coating composition has a pH above 7.

19. A process according to claim 1 wherein the coating compositions contains, per 100 parts by weight solids, 60 to 95 parts pigment, 5 to 40 parts binder of which more than 50% dry weight is said polymer, and 50 to 120 parts water.

20. A process according to claim 2 wherein the coating composition contains, per 100 parts by weight solids, 60 to 95 parts pigment, 5 to 40 parts binder of which more than 50% dry weight is said polymer, and 50 to 120 parts water.

21. A process according to claim 1 in which said polymer is a polymer of a vinyl ester of a carboxylic acid.

22. A process according to claim 2 in which said polymer is a polymer of a vinyl ester of a carboxylic acid.

23. A process according to claim 1 in which said polymer is a vinyl acetate polymer.

24. A process according to claim 2 in which said polymer is a vinyl acetate polymer.

25. A process according to claim 1 in which up to 60% dry weight of the binder is a supplementary binder selected from latices having Tg below 0° C. and latices having Tg above 45° C.

26. A process according to claim 2 in which up to 60% dry weight of the binder is a supplementary binder selected from latices having Tg below 0° C. and latices having Tg above 45° C.

27. A process according to claim 25 in which the supplementary binder is selected from butadiene methylmethacrylate copolymers and styrene acrylic copolymers.

28. A process according to claim 26 in which the supplementary binder is selected from butadiene methylmethacrylate copolymers and styrene acrylic copolymers.

* * * * *